US010842256B2

(12) United States Patent
Ko

(10) Patent No.: US 10,842,256 B2
(45) Date of Patent: Nov. 24, 2020

(54) FOLDABLE TABLE LEG

(71) Applicant: Wen-Shan Ko, Lugang Township, Changhua County (TW)

(72) Inventor: Wen-Shan Ko, Lugang Township, Changhua County (TW)

( * ) Notice: Subject to any disclaimer, the term of this patent is extended or adjusted under 35 U.S.C. 154(b) by 0 days.

(21) Appl. No.: 16/544,167

(22) Filed: Aug. 19, 2019

(65) Prior Publication Data

US 2020/0221862 A1 Jul. 16, 2020

(30) Foreign Application Priority Data

Jan. 10, 2019 (TW) ..... 108200451 A

(51) Int. Cl.
*A47B 3/00* (2006.01)
*A47B 3/091* (2006.01)

(52) U.S. Cl.
CPC ..... *A47B 3/0911* (2013.01)

(58) Field of Classification Search
CPC ..... Y10T 16/54024; Y10T 16/540247; Y10T 16/54033; Y10T 16/5409; E05D 5/02; E05D 5/0207; E05D 5/0215; E05D 5/046; E05D 5/06; E05D 5/065; A47B 3/08; A47B 2003/0821; A47B 2003/0824
USPC ..... 248/166, 439, 188.6, 291.1; 108/115, 108/160; 16/387, 389, 382, 383, 384
See application file for complete search history.

(56) References Cited

U.S. PATENT DOCUMENTS 1,138,846 A * 5/1915 Cook ..... B60J 7/1204 16/352
1,456,574 A * 5/1923 Roberts ..... A47B 3/0818 16/366
5,026,028 A * 6/1991 Ooi ..... E04F 11/1834 248/251
D336,394 S * 6/1993 Ball ..... D6/656.13
5,251,359 A * 10/1993 Finkl ..... E05D 11/06 16/348
D399,683 S * 10/1998 Nicklas ..... D6/656.16
8,047,488 B2 * 11/2011 Wang ..... F16M 11/10 248/176.1
D882,988 S * 5/2020 Hu ..... D6/656.17
2004/0051011 A1 * 3/2004 Degen ..... B25H 1/00 248/166

(Continued)

FOREIGN PATENT DOCUMENTS

WO 2014006587 * 1/2014
WO 2017161163 * 9/2017

*Primary Examiner* — Janet M Wilkens
(74) *Attorney, Agent, or Firm* — Muncy, Geissler, Olds & Lowe, P.C.

(57) ABSTRACT

A foldable table leg includes a vertical pole, an inclined pole and two positioning members. The vertical pole is provided on the peripheral surface thereof with two protruding lugs facing each other. An end of the inclined pole is pivotably connected to the protruding lugs of the vertical pole in a way that the inclined pole is pivotable relative to the vertical pole between an unfolded position and a folded position. The positioning members fasten the protruding lugs of the vertical pole to an end of the inclined pole in a detachable manner, for positioning the inclined pole at the unfolded position. When the positioning members are detached, the inclined pole is pivotable from the unfolded position to the folded position, so that the objective of reducing the cubic volume and saving space is attained after the inclined pole is folded.

6 Claims, 7 Drawing Sheets

(56) References Cited

U.S. PATENT DOCUMENTS

| | | | | |
|---|---|---|---|---|
| 2005/0172869 | A1* | 8/2005 | Schmidt | A47B 17/003 108/147 |
| 2011/0017692 | A1* | 1/2011 | Marietta | A47B 43/00 211/195 |
| 2017/0273451 | A1* | 9/2017 | JeanPhilippe | A47C 4/24 |

* cited by examiner

FOLDABLE TABLE LEG

BACKGROUND OF THE INVENTION

1. Field of the Invention

The present invention relates to table legs and more particularly, to a foldable table leg.

2. Description of the Related Art

For the stability of the table, the fixed structure is mainly used in the legs of the ordinary tables. However, the fixed table leg cannot be folded, resulting in too much space occupied in transportation or storage. If it is to be disassembled, the process of the disassembly is bothersome and consumes a long time. When it is to be used again, it needs to be reassembled, so it is quite inconvenient to use.

SUMMARY OF THE INVENTION

It is a primary objective of the present invention to provide a foldable table leg which can be reduced in cubic volume and save space.

To attain the above primary objective, the table leg of the present invention includes a vertical pole, an inclined pole and two positioning members. The vertical pole is provided on the peripheral surface thereof with two protruding lugs facing each other. The inclined pole has a pivotably connected end which is pivotably connected to the two protruding lugs of the vertical pole in a way that the inclined pole is pivotable relative to the vertical pole between an unfolded position and a folded position. Each of the positioning members is detachably attached to one of the protruding lugs of the vertical pole and the pivotably connected end of the inclined pole for positioning the inclined pole at the unfolded position.

Through the above-described configuration design, when the foldable table leg is to be transported, the inclined pole can be folded as long as the two positioning members are detached, so that the effects of reducing cubic volume and saving occupied space are attained. After the foldable table leg is transported in position, the inclined pole can be pivoted to the unfolded position, and then the two positioning members can be screwed on again to position the inclined pole.

Preferably, the pivotably connected end of the inclined pole is pivotably connected to the two protruding lugs of the vertical pole indirectly through a connecting block.

Preferably, each of the protruding lugs of the vertical pole has a first top hole, a first bottom hole coaxially corresponding to the first top hole, and a first accommodating trough communicating with the first top hole and the first bottom hole; the pivotably connected end of the inclined pole has two first threaded holes; each of the positioning members has a head portion and a threaded rod connected with the head portion; the head portion of each of the positioning members is located in the first accommodating trough of one of the protruding lugs; the external radius of the head portion of each of the positioning members is larger than the inner radius of the first top hole and smaller than the inner radius of the first bottom hole; the threaded rod of each of the positioning members is inserted through the first top hole of one of the protruding lugs and screwed into one of the first threaded holes of the pivotably connected end of the inclined pole. In this way, when the two positioning members are completely screwed on, they are hided in the protruding lugs respectively, not exposed outside.

Preferably, the pivotably connected end of the inclined pole is provided on each of two opposite sides thereof with a flank plate; when the inclined pole is located at the unfolded position, the two flank plates are abutted on the peripheral surface of the vertical pole and cover the two protruding lugs, for maintaining the completeness of the appearance of the whole structure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
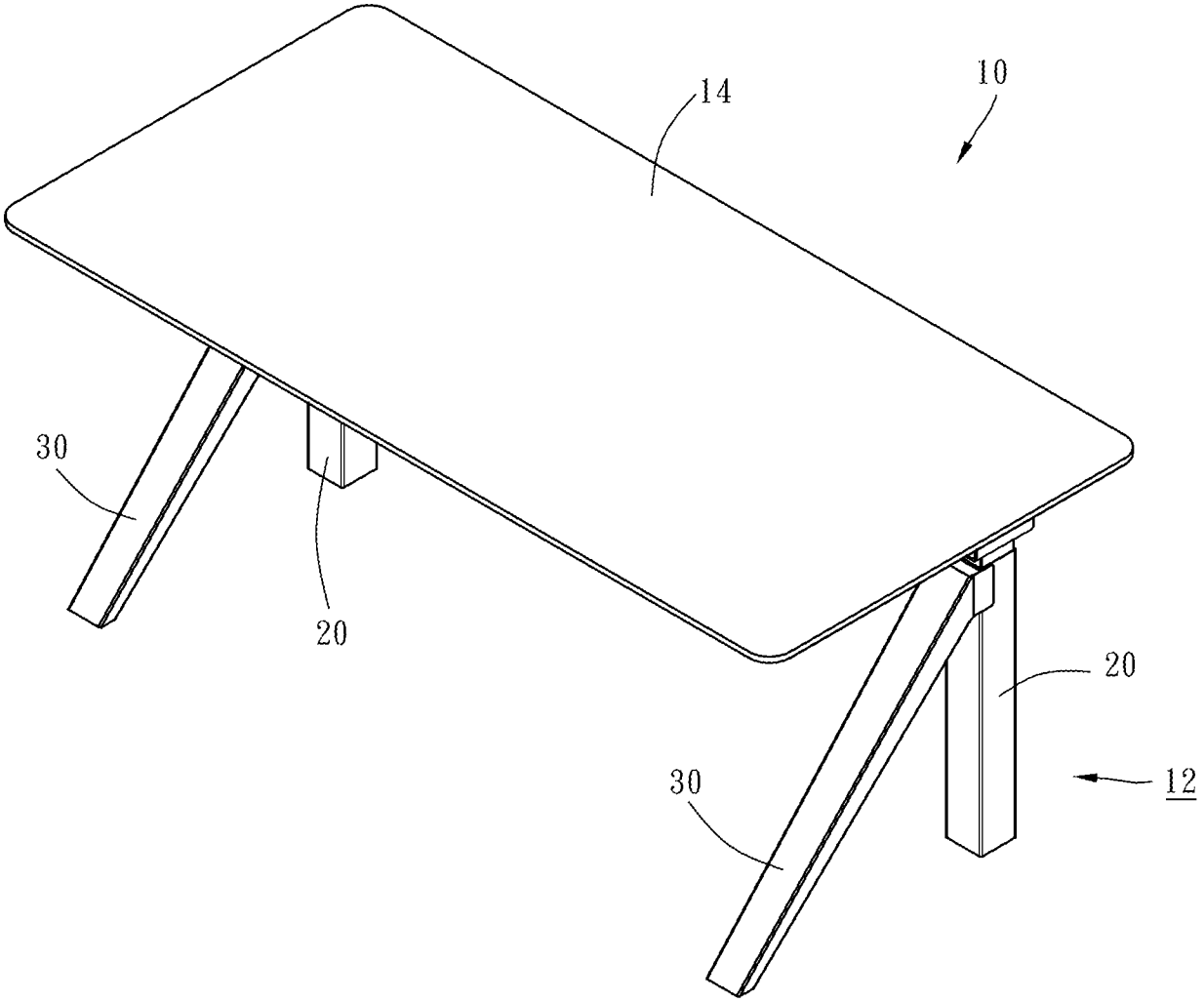
FIG. 1 is a perspective view of the appearance of a table using table legs of the present invention.

First of all, it is to be mentioned that throughout the specification, including the embodiments described below and the claims, the nouns relating to directionality are based on the directions in the figures. Besides, same reference numerals used in the following preferred embodiments and the appendix drawings designate same or similar elements or the structural features thereof.

Figure 2:
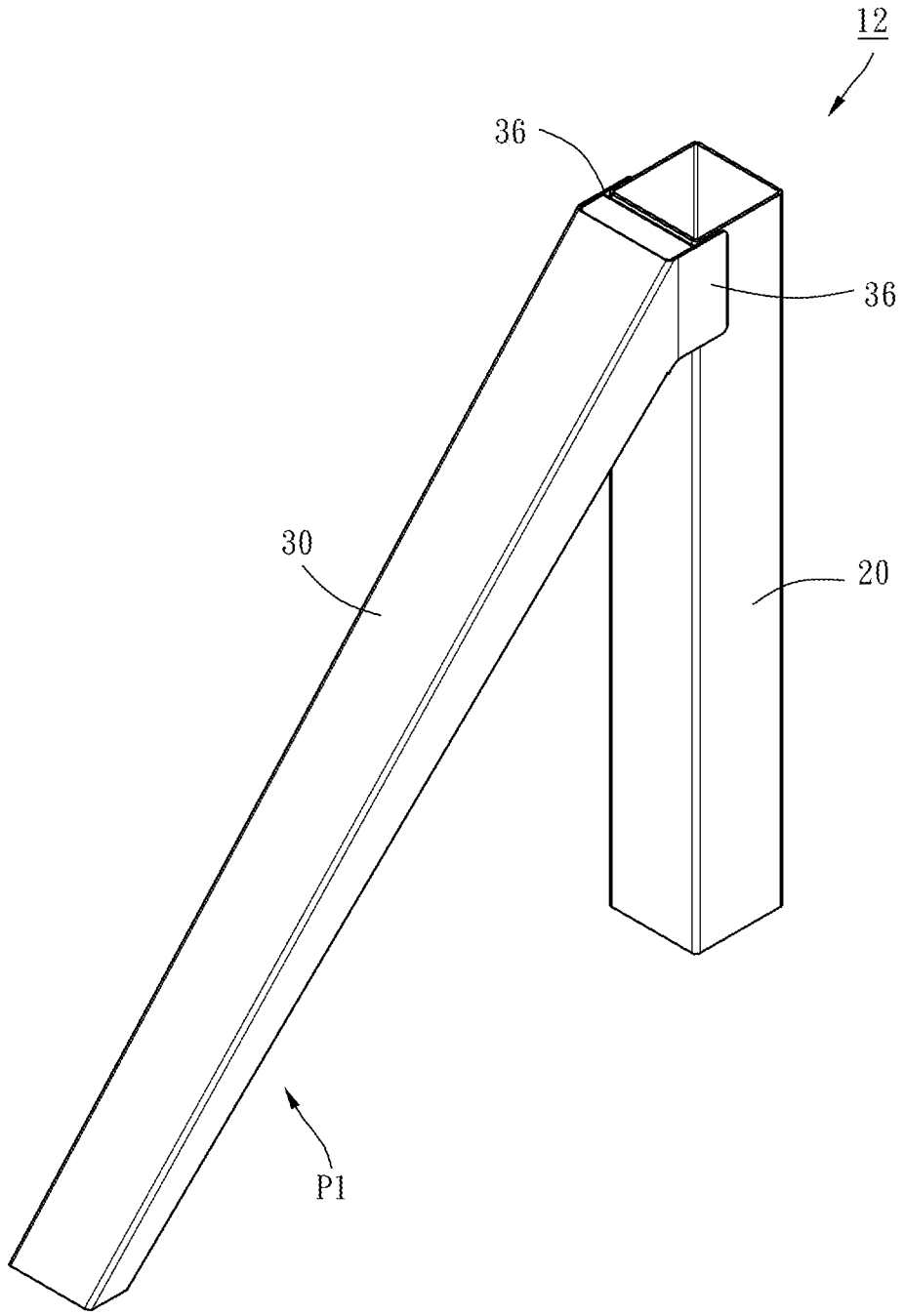
FIG. 2 is a perspective view of the appearance of the table leg of the present invention, primarily showing an inclined pole is located at an unfolded position.
Figure 3:
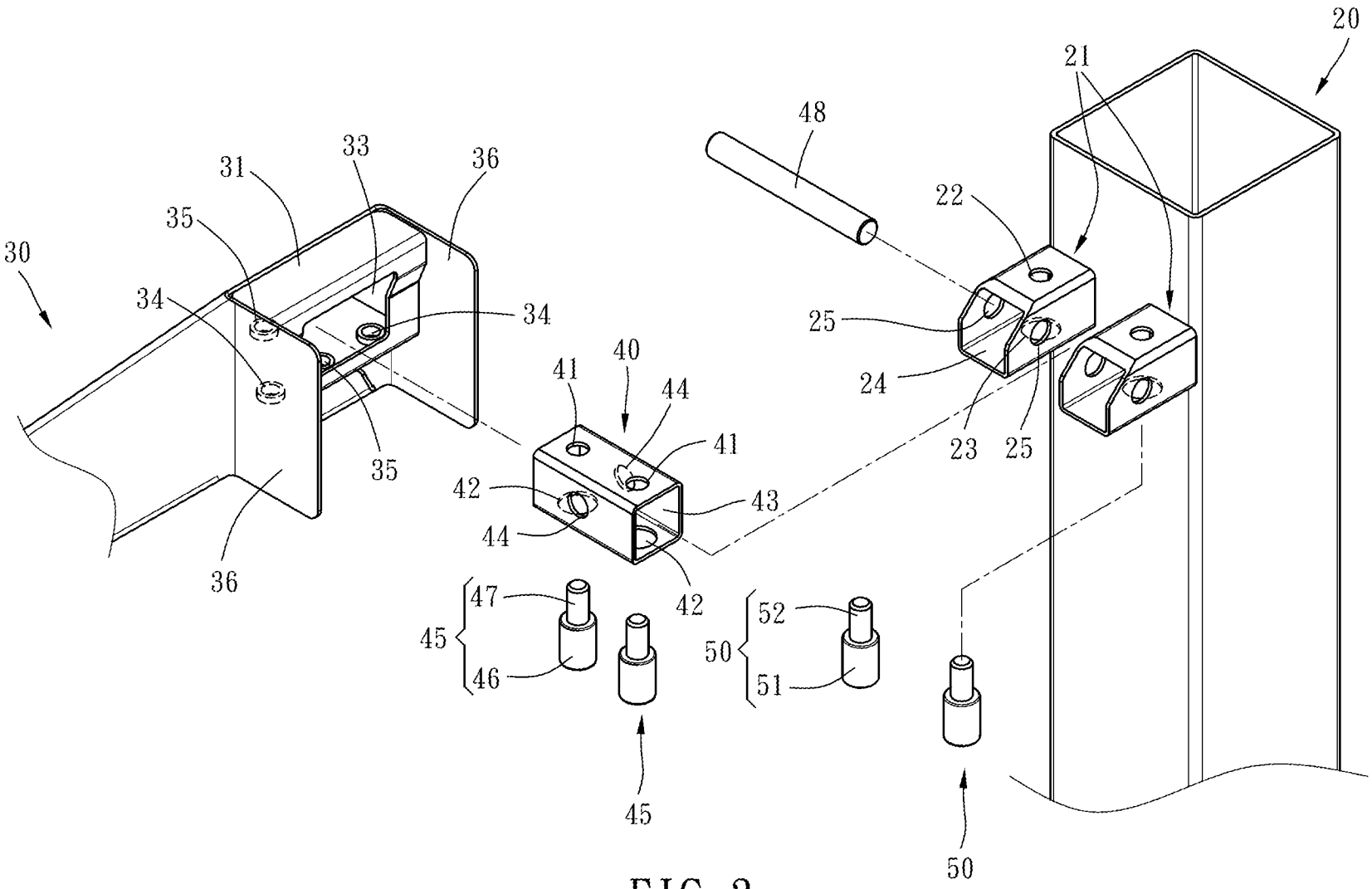
FIG. 3 is an exploded perspective view of the table leg of the present invention.

Referring to FIG. 1, the table leg 12 of the present invention is adapted to support a table top 14 on the bottom surface thereof in pairs, so that the table top 14 and a pair of table legs 12 collectively constitute a table 10. Referring to FIGS. 2 and 3, the table leg 12 of the present invention includes a vertical pole 20, an inclined pole 30 and two positioning members 50.

The cross-section of the vertical pole 20 is rectangular-shaped. The vertical pole 20 is provided on the front side thereof with two protruding lugs 21 facing each other. Each of the protruding lugs 21 has a first top hole 22, a first bottom hole 23 coaxially corresponding to the first top hole 22, a first accommodating trough 24 communicating with the first top hole 22 and the first bottom hole 23, and two first lateral holes 25 communicating with the first accommodating trough 24.

Figure 4:
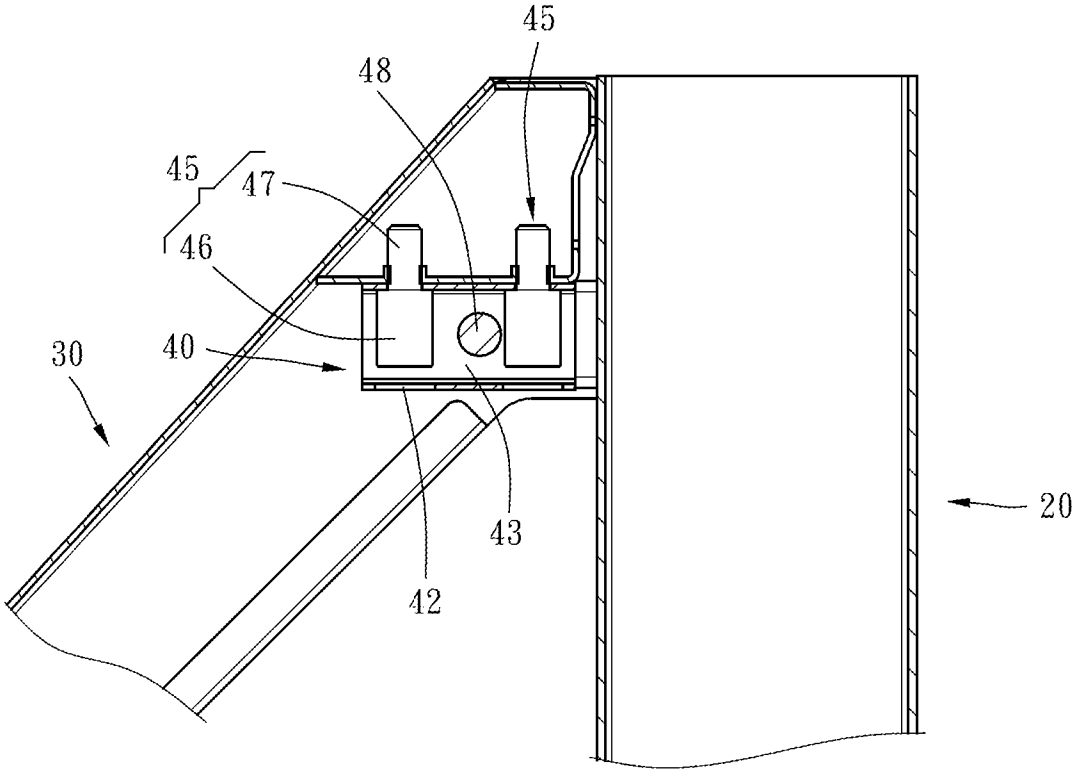
FIG. 4 is a sectional view of the table leg of the present invention when the inclined pole is located at the unfolded position.
Figure 5:
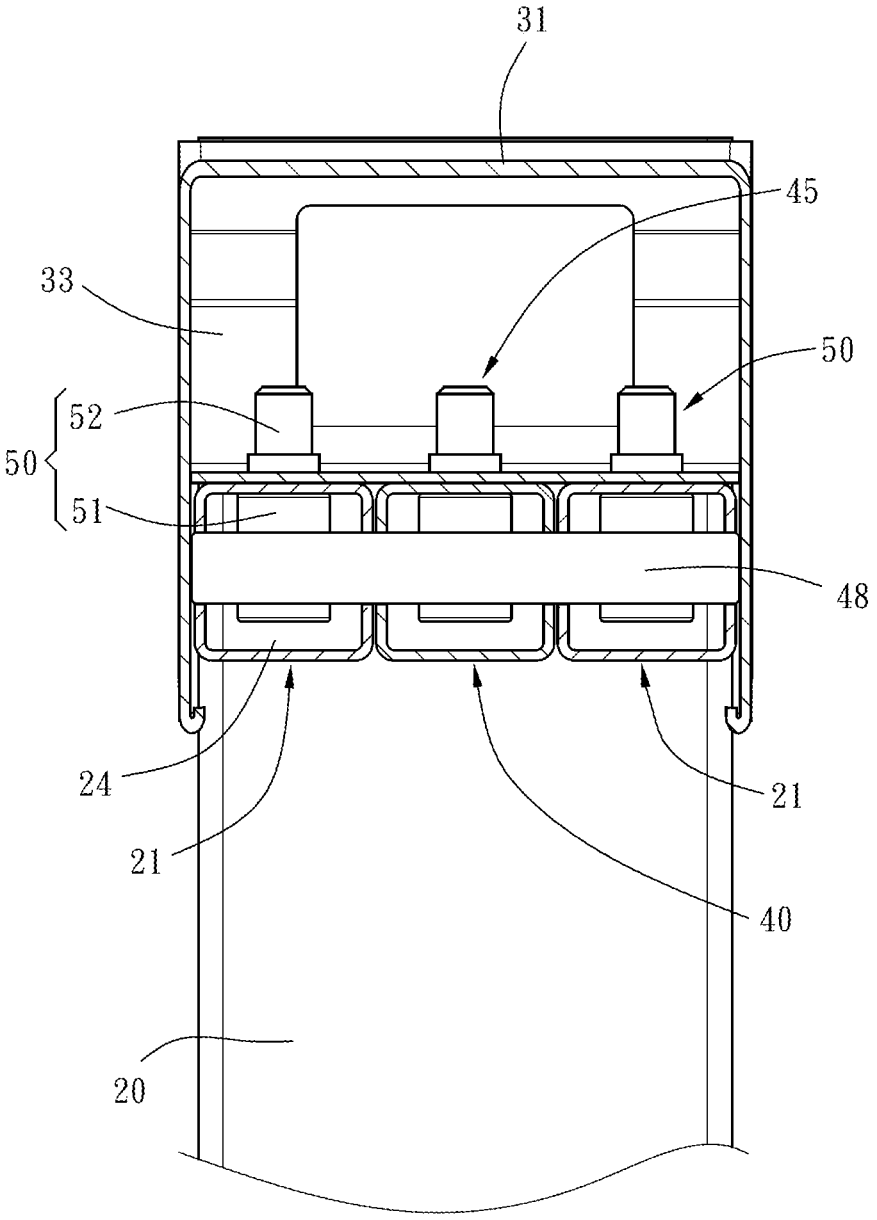
FIG. 5 is another sectional view of the table leg of the present invention when the inclined pole is located at the unfolded position.
Figure 6:
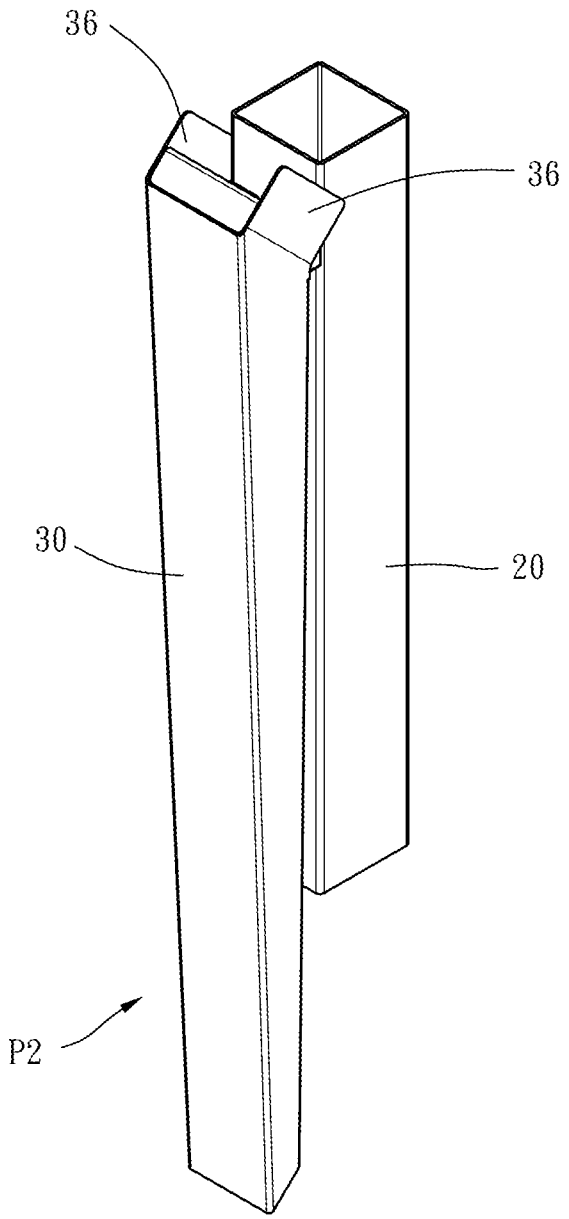
FIG. 6 is a perspective view of the appearance of the table leg of the present invention, primarily showing the inclined pole is located at a folded position.
Figure 7:
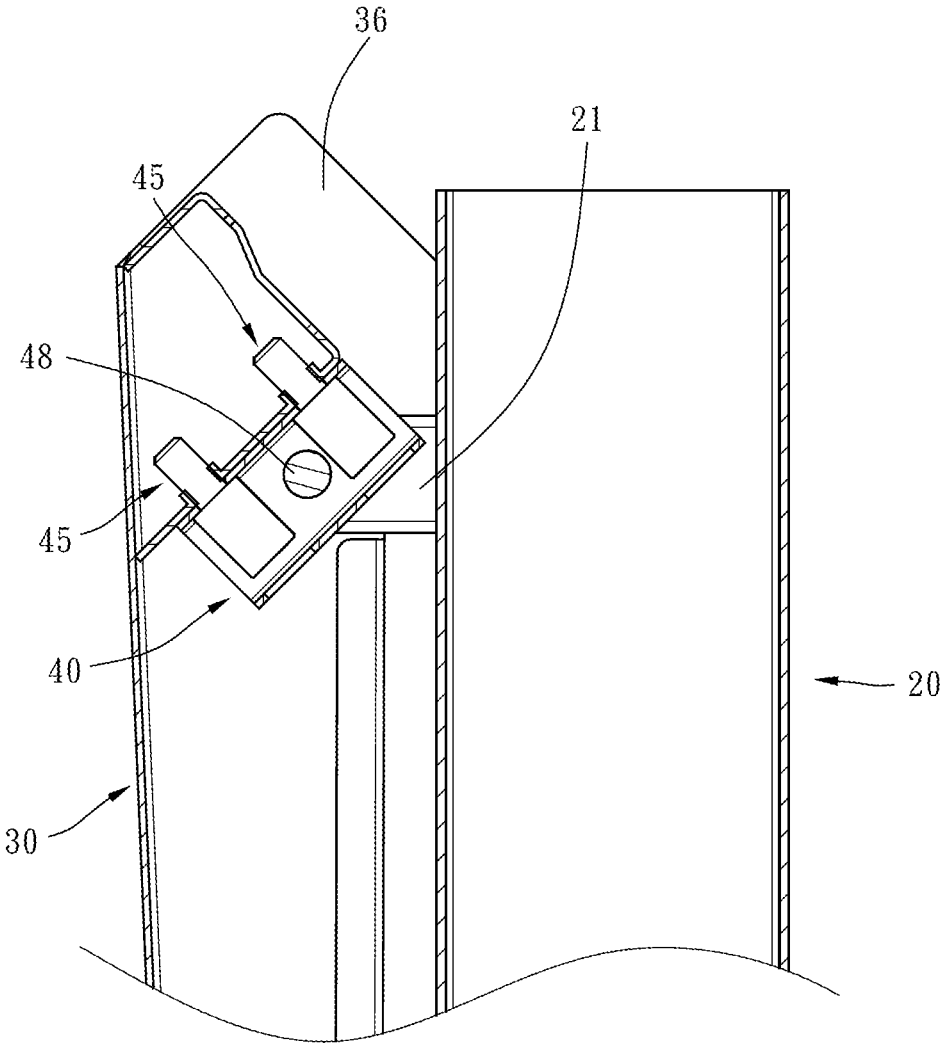
FIG. 7 is a sectional view of the table leg of the present invention when the inclined pole is located at the folded position.

The top end of the inclined pole 30 is formed as a pivotably connected end 31. The pivotably connected end 31 of the inclined pole 30 has an inserting trough 33, two first threaded holes 34 communicating with the inserting trough 33 and two second threaded holes 35 communicating with the inserting trough 33. The pivotably connected end 31 of the inclined pole 30 is pivotably connected to the two protruding lugs 21 of the vertical pole 20 indirectly through a connecting block 40. The connecting block 40 is inserted in the inserting trough 33 and the connecting block 40 has two second top holes 41, two second bottom holes 42 coaxially corresponding to the second top holes 41, a second accommodating trough 43 communicating with the second top holes 41 and the second bottom holes 42, and two second lateral holes 44 communicating with the second accommodating trough 43. The connecting block 40 is fastened to the pivotably connected end 31 of the inclined pole 30 by two fasteners 45 and pivotably connected between the two protruding lugs 21 of the vertical pole 20 through a pivot 48. Each of the fasteners 45 has a head portion 46 and a threaded rod 47 connected with the head portion 46, as shown in FIGS. 3 and 4. The head portion 46 of each fastener 45 is located in the second accommodating trough 43 of the connecting block 40. The external radius of the head portion 46 of each fastener 45 is larger than the inner radius of the second top hole 41 of the connecting block 40 and smaller than the inner radius of the second bottom hole 42 of the connecting block 40. The threaded rod 47 of each fastener 45 is inserted through the second top hole 41 of the connecting block 40 and screwed into the second threaded hole 35 of the pivotably connected end 31 of the inclined pole 30. The pivot 48 is inserted through the first lateral holes 25 of the two protruding lugs 21 of the vertical pole 20 and the second lateral holes 44 of the connecting block 40, as shown in FIGS. 3 and 5, so that the inclined pole 30 is pivotable relative to the vertical pole 20 between an unfolded position as shown in FIG. 2 and a folded position as shown in FIG. 6.

The positioning member 50 has a head portion 51 and a threaded rod 52 connected with the head portion 51. The head portion 51 of the positioning member 50 is located in the first accommodating trough 24 of the protruding lug 21. The external radius of the head portion 51 of the positioning member 50 is larger than the inner radius of the first top hole 22 of the protruding lug 21 and smaller than the inner radius of the first bottom hole 23 of the protruding lug 21. The threaded rod 52 of the positioning member 50 is inserted through the first top hole 22 of the protruding lug 21 and screwed into a first threaded hole 34 of the pivotably connected end 31 of the inclined pole 30. In this way, when the two positioning members 50 are screwed on, the inclined pole 30 is positioned at the unfolded position P1; when the two positioning members 50 are detached, the inclined pole 30 is pivotable between the unfolded position P1 and the folded position P2.

It can be known from the above description that when the table 10 is to be transported, the positioning members 50 are detached by a hand tool, such as a screw driver not shown in the figures, which is inserted into the first accommodating trough 24 of the protruding lug 21 through the first bottom hole 23 of the protruding lug 21. Because the inner radius of the first bottom hole 23 of the protruding lug 21 is larger than the external radius of the head portion 51 of the positioning member 50, the positioning member 50 after being detached can be taken out from the first accommodating trough 24 of the protruding lug 21 to be put at an appropriate location. After that, the inclined pole 30 can be pivoted from the unfolded position P1 as shown in FIG. 2 to the folded position P2 as shown in FIG. 6. After the table 10 is transported in position, the inclined pole 30 can be pivoted from the folded position P2 as shown in FIG. 6 to the unfolded position P1 as shown in FIG. 2, and then the positioning members 50 are screwed on again to position the inclined pole 30 at the unfolded position P1. At this time, the positioning members 50 are hided in the inserting trough 33 of the inclined pole 30 and the accommodating troughs 24 of the protruding lugs 21, not exposed outside. In other words, the table leg 12 of the present invention can be reduced in cubic volume and save occupied space after being folded, that is advantageous to transportion or storage. When it is to be used again, it can be unfolded and positioned as long as the two positioning members 50 are screwed on again.

On the other hand, the pivotably connected end 31 of the inclined pole 30 is provided on each of the left and right sides thereof with a flank plate 36. When the inclined pole 30 is located at the unfolded position P1 as shown in FIG. 2, the two flank plates 36 are abutted on the left and right sides of the vertical pole 20 and cover the two protruding lugs 21. In this way, the structural stability of the inclined pole 30 after being unfolded is enhanced, and the appearance of the whole table leg 12 is maintained with great completeness.

What is claimed is:

1. A foldable table leg comprising:

a vertical pole which is provided on a peripheral surface thereof with two protruding lugs facing each other;

an inclined pole having a pivotably connected end which is pivotably connected to the two protruding lugs of the vertical pole in a way that the inclined pole is pivotable relative to the vertical pole between an unfolded position and a folded position; and two positioning members detachably attached to the protruding lugs of the vertical pole respectively and the pivotably connected end of the inclined pole for positioning the inclined pole at the unfolded position;

wherein each of the protruding lugs of the vertical pole has a first top hole, a first bottom hole coaxially corresponding to the first top hole, and a first accommodating trough communicating with the first top hole and the first bottom hole; the pivotably connected end of the inclined pole has two first threaded holes; each of the positioning members has a head portion and a threaded rod connected with the head portion; the head portion of each of the positioning members is located in the first accommodating trough of one of the protruding lugs;

an external radius of the head portion of each of the positioning members is larger than an inner radius of the first top hole and smaller than an inner radius of the first bottom hole; the threaded rod of each of the positioning members is inserted through the first top hole of one of the protruding lugs and screwed into one of the first threaded holes of the pivotably connected end of the inclined pole.

2. The foldable table leg as claimed in claim 1, wherein when the two positioning members are detached, the inclined pole is pivotable between the unfolded position and the folded position.

3. The foldable table leg as claimed in claim 1, wherein the pivotably connected end of the inclined pole has an inserting trough; the two protruding lugs of the vertical pole are pivotably connected with a connecting block together;

the connecting block is inserted in the inserting trough and fastened to the pivotably connected end of the inclined pole.

4. The foldable table leg as claimed in claim 3, wherein the pivotably connected end of the inclined pole has a second threaded hole; the connecting block has a second top hole, a second bottom hole coaxially corresponding to the second top hole, and a second accommodating trough communicating with the second top hole and the second bottom hole; the pivotably connected end of the inclined pole is fastened to the connecting block by a fastener; the fastener has a head portion and a threaded rod connected with the head portion; the head portion of the fastener is located in the second accommodating trough of the connecting block; an external radius of the head portion of the fastener is larger than an inner radius of the second top hole of the connecting block and smaller than an inner radius of the second bottom hole of the connecting block; the threaded rod of the fastener is inserted through the second top hole of the connecting block and screwed into the second threaded hole of the pivotably connected end of the inclined pole.

5. The foldable table leg as claimed in claim 4, wherein the pivotably connected end of the inclined pole is provided on each of two opposite sides thereof with a flank plate;

when the inclined pole is located at the unfolded position, the two flank plates are abutted on the peripheral surface of the vertical pole and cover the two protruding lugs.

6. The foldable table leg as claimed in claim 1, wherein the pivotably connected end of the inclined pole is provided on each of two opposite sides thereof with a flank plate;

when the inclined pole is located at the unfolded position, the two flank plates are abutted on the peripheral surface of the vertical pole and cover the two protruding lugs.

* * * * *